US006631530B1

(12) United States Patent
Makofsky

(10) Patent No.: US 6,631,530 B1
(45) Date of Patent: Oct. 14, 2003

(54) MODULAR BRIDGE APPARATUS

(76) Inventor: Donald C. Makofsky, 2218 Jay St., New Orleans, LA (US) 70122

( * ) Notice: Subject to any disclaimer, the term of this patent is extended or adjusted under 35 U.S.C. 154(b) by 120 days.

(21) Appl. No.: 09/854,878

(22) Filed: May 14, 2001

(51) Int. Cl.[7] ..... E01D 19/00

(52) U.S. Cl. ..... 14/13; 14/14; 14/2.4; 14/3

(58) Field of Search ..... 14/2.4, 3, 4, 6, 14/13, 14

(56) References Cited

U.S. PATENT DOCUMENTS

| | | | | |
|---|---|---|---|---|
| 132,860 A | * | 11/1872 | Russell | 14/4 |
| 146,332 A | * | 1/1874 | Graham | 14/4 |
| 219,846 A | * | 9/1879 | Borneman | 14/4 |
| 294,606 A | * | 3/1884 | Frits | 14/13 |
| 328,758 A | * | 10/1885 | Carr | 14/4 |
| 428,338 A | * | 5/1890 | Hill | 14/4 |
| 502,165 A | * | 7/1893 | Ball | 14/4 |
| 536,680 A | * | 4/1895 | Avery | 14/4 |
| 762,632 A | * | 6/1904 | Headley | 14/4 |
| 2,329,906 A | * | 9/1943 | Inglis | 14/14 |
| 4,965,903 A | | 10/1990 | Bisch | 14/1 |
| 5,261,138 A | | 11/1993 | Drago et al. | 14/77.1 |
| 5,570,486 A | * | 11/1996 | Wiedeck | 14/13 |
| 5,901,396 A | | 5/1999 | Ahlskog et al. | 14/77.1 |

FOREIGN PATENT DOCUMENTS

| | | | | |
|---|---|---|---|---|
| GB | 2139672 A | * | 11/1984 | E01D/5/00 |

* cited by examiner

*Primary Examiner*—Thomas B Will
*Assistant Examiner*—Alexandra K Pechhold
(74) *Attorney, Agent, or Firm*—Garvey, Smith, Nehrbass & Doody, L.L.C.; Charles C. Garvey, Jr.; Seth M. Nehrbass

(57) ABSTRACT

A modular bridge apparatus includes a self-supporting truss section that can be lifted and transported as a structural unit. The modular bridge has left and right longitudinally extending trusses. Each truss section is made of an upper longitudinal chord member and a lower longitudinal chord member which are connected together at a plurality of joints with vertical and diagonally inclined web members. In the preferred embodiment, these longitudinally extending trusses occur on opposite sides of the bridge, defining the sides of the road surface and extend between supports on each end. A plurality of transverse beams extend between the left and right side trusses of the bridge at an elevation that is higher than the lower longitudinal chord members of the trusses. Some of the transverse beams extend beyond the lower longitudinal chord member, and are connected to the upper longitudinal chord members with an inclined diagonal kicker. A plurality of longitudinal deck beams extend between the transverse beams at the same elevation as the transverse beams. An expansive bridge decking is provided and is attached to the truss at the deck beams to provide a road surface for vehicles, pedestrians and the like. A plurality of diagonal beams extending from the left to right trusses between adjacent vertical web members.

30 Claims, 7 Drawing Sheets

MODULAR BRIDGE APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved modular bridge construction comprised of left and right trusses and a number of beam members that are connectable together. The beams include longitudinally and transverse beams that carry decking, at least some of the transverse beams extending laterally beyond the decking and wherein diagonally extending kickers extend from the end portions of at least some of the transverse beams to provide lateral support to left and right side trusses of the bridge. Each truss section is preferably made of an upper longitudinal chord member and a lower longitudinal chord member which are connected together at a plurality of joints with vertical and diagonally inclined webbed members. The transverse beams extend laterally between the left and right side trusses of the bridge at an elevation that is higher than the lower longitudinal chord members of the trusses.

2. General Background of the Invention

In rural areas, hilly terrain produces low spots in roads that can become a hazardous crossing if rainfall has been intense. These low lying areas can become inundated with water so that the road can no longer be traveled by an automobile, bus, truck or other vehicle.

Hilly terrain can produce numerous low spots for a given road, sometimes several within a given mile problem for rural communities. Bridges are typically very expensive to construct. Therefore, each and every depression of a road that becomes inundated after a rain cannot always be protected for travel.

Modular bridges have been used for many years in order to provide a temporary structure for crossing a stream, river or canal. Examples of modular bridge construction that have issued as patents include U.S. Nos. 4,965,903; 5,261,138; and 5,901,396.

BRIEF SUMMARY OF THE INVENTION

The present invention provides an improved modular bridge apparatus. The apparatus is in the form of at least one self-supporting truss section that can be lifted and transported as a structural unit, using a small crane or like lifting device. The bridge apparatus includes left and right side portions, a top and a bottom. In addition, the bridge components can be erected in their final locations with just manpower and possibly some small lifting aids along with some strategically located temporary shoring.

The modular bridge has left and right trusses. Each truss section is made of an upper longitudinal chord member and a lower longitudinal chord member, which are connected together at a plurality of joints with vertical and diagonally inclined web members.

In the preferred embodiment, these longitudinally extending trusses occur on opposite sides of the bridge, defining the sides of the road surface and each extends between supports on each end.

A plurality of transverse beams extend laterally between the left and right side trusses of the bridge at an elevation that is higher than the lower longitudinal chord members of the trusses. Some of the transverse beams extend beyond the lower longitudinal chord member, and are connected to the upper longitudinal chord member with an inclined diagonal kicker.

A plurality of longitudinal deck beams extend between the transverse beams at the same elevation as the transverse beams.

An expansive bridge decking is provided and is attached to the truss at the deck beams to provide a road surface for vehicles, pedestrians and the like.

A plurality of horizontally extending diagonal beams extends from the left to right trusses between adjacent vertical web members.

Decking provides an expansive surface that is attached to the truss at the deck beams, providing a road surface for vehicles.

In the preferred embodiment, there are a first plurality of transverse deck beams of a first shorter length and a second plurality of transverse deck beams of a second, longer length.

In the preferred embodiment, there are a plurality of the diagonally and laterally extending inclined beams or "kickers".

In the preferred embodiment, the joints include removable connections such as bolted connections that enable the entire bridge apparatus to be transported to a selected location and then assembled at the selected site. However, once assembled at a selected site, the entire bridge truss section can be lifted for final placement at a precise position for enabling crossing of a river, brook, stream or the like.

The apparatus of the present invention preferably positions the bridge decking at an elevation that is spaced above the longitudinal chord members of each truss section.

The decking preferably has a width and at least some of the transverse beams extend transversely beyond the width of the decking.

The decking preferably has left and right sides. At least some of the transverse beams extend transversely to the sides of the decking, while other of the transverse beams extend transversely beyond the width of the decking, beyond both sides of the decking.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
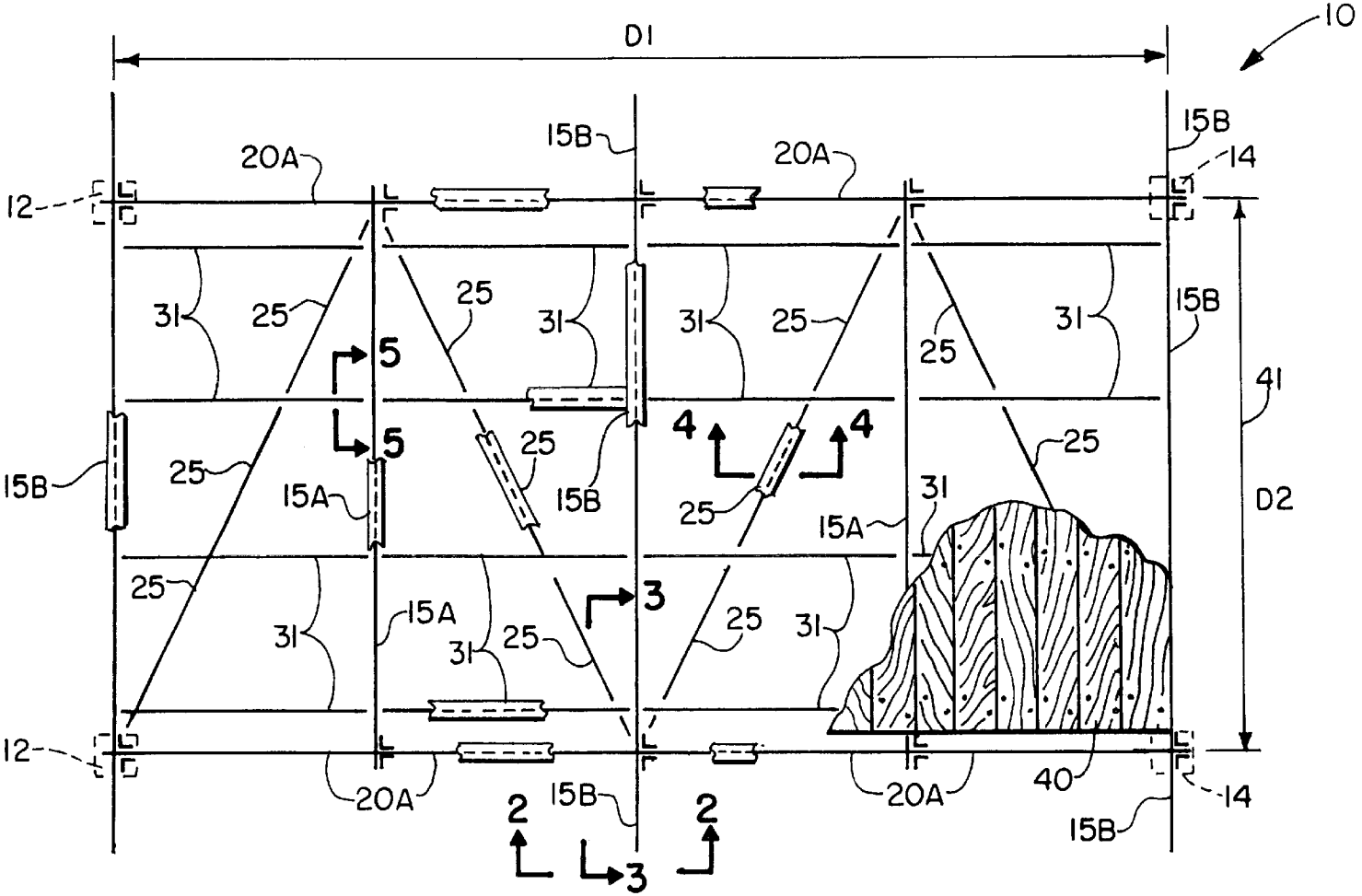
FIG. 1 is a plan view of the preferred embodiment of the apparatus of the present invention.

FIGS. 1, 6, 7 and 8 show the preferred embodiment of the apparatus of the present invention designated generally by the numeral 10. Bridge apparatus 10 has an end portion 11 that can be supported upon footing 12 (or other suitable foundation) and an opposing end portion 13 that can be supported upon footing 14 (or other suitable foundation).

Bridge apparatus 10 can be very quickly and easily erected at a selected site for bridging a depression, stream bed, river bed or like low lying area. Once assembled near a selected site, bridge 10 is a self-supporting truss section that can be lifted with a crane, dragline or other lifting device for final placement over a stream, brook or other formation. Bridge 10 can be assembled first into two half sections 10A, 10B and then bolted together at splices 43.

Bridge 10 has left longitudinal truss 37 and right longitudinal truss 38. Each truss 37, 38 is made up of an upper longitudinal chord member 20A and a lower longitudinal chord member 20B (see FIGS. 1–3 and 7). The upper longitudinal chord members 20A and lower longitudinal chord members 20B are connected by a plurality of joints 39 (see FIGS. 1–3 and 7) with vertical 30 and diagonally extending 34 web members. In the preferred embodiment, these longitudinal trusses 37, 38 occur on opposite sides of the bridge apparatus 10, defining the sides of the decking 40 (road surface) and extend between supports on each end. In addition, the bridge components can be erected in their final locations with just manpower and possibly some small lifting aids along with some strategically located temporary shoring.

Figure 9:
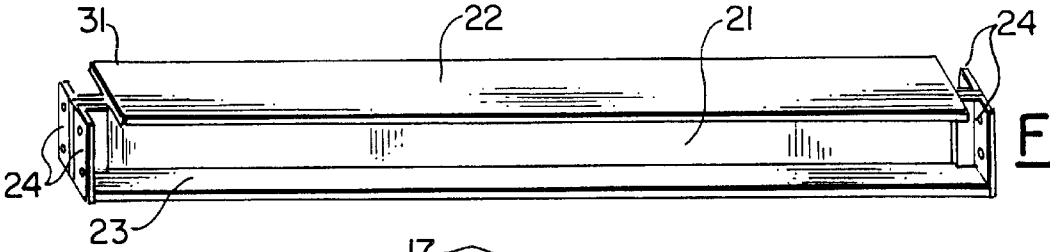
FIG. 9 is a fragmentary view of the preferred embodiment of the apparatus of the present invention illustrating one of the longitudinal beam members.
Figure 10:
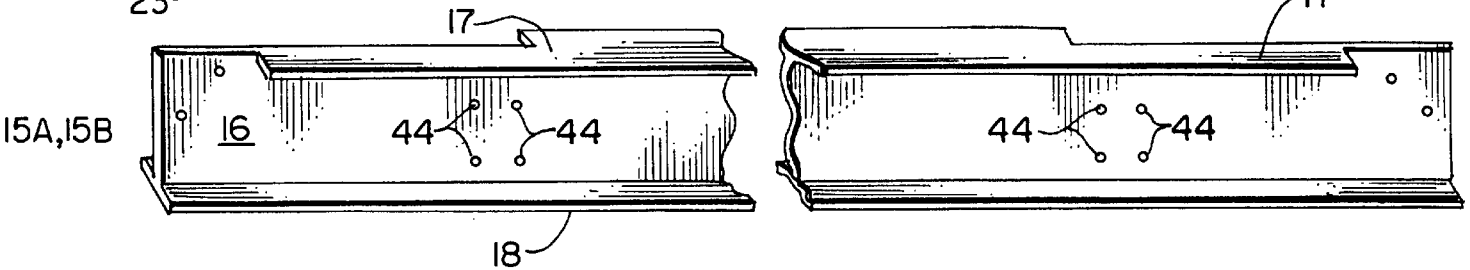
FIG. 10 is a fragmentary perspective view of the preferred embodiment of the apparatus of the present invention illustrating one of the transverse beam members.

A plurality of transverse beams 15A, 15B extend laterally between the left and right trusses 37, 38 of the bridge at an elevation that is higher than the elevation of the lower longitudinal chord members 20B. A plurality of longitudinal deck beams 31 extend between the transverse beams at the same elevation as to transverse beams 15A, 15B. In FIGS. 2, 3 and 10, each transverse beam 15A, 15B has a web 16, upper flange 17 and lower flange 18. In FIG. 9, each longitudinal deck beam 20A, 20B has a web 21, upper flange 22, and lower flange 23. Beams 15A are shorter beams that extend the distance between trusses 37, 38. Beams 15B are longer beams that extend transversely beyond the trusses 37, 38 as shown in FIGS. 1, 3 and 7.

Clip angles or like fittings 24 can be provided at each of the end portions of each longitudinal beam 20A, 20B as shown in FIG. 9. A plurality of openings 44 can be provided in the web 16 of each transverse beam 15A, 15B so that quick connections (for example, bolted connections) 19 can be made between a selected end portion of a longitudinal chord member 20A, 20B with the web 16 of a transverse beam 15A, 15B (see for example, FIGS. 2, 5 and 9, 10). Upper longitudinal chord member 20A and lower longitudinal chord member 20B can each be "tee" beams having a generally vertically extending web 35 and a generally horizontally positioned flange 36.

Figure 2:
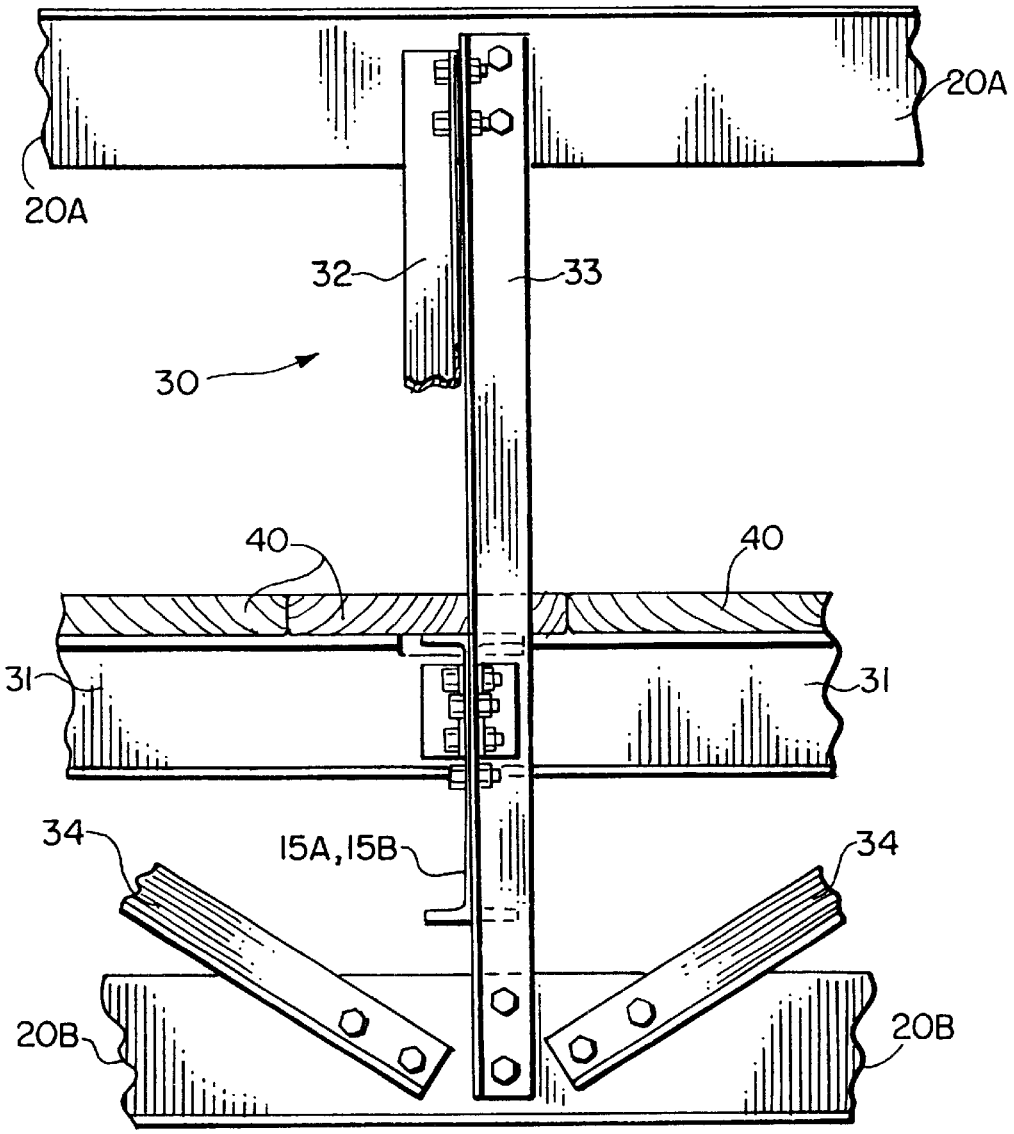
FIG. 2 is a sectional view taken along lines 2—2 of FIG. 1.
Figure 3:
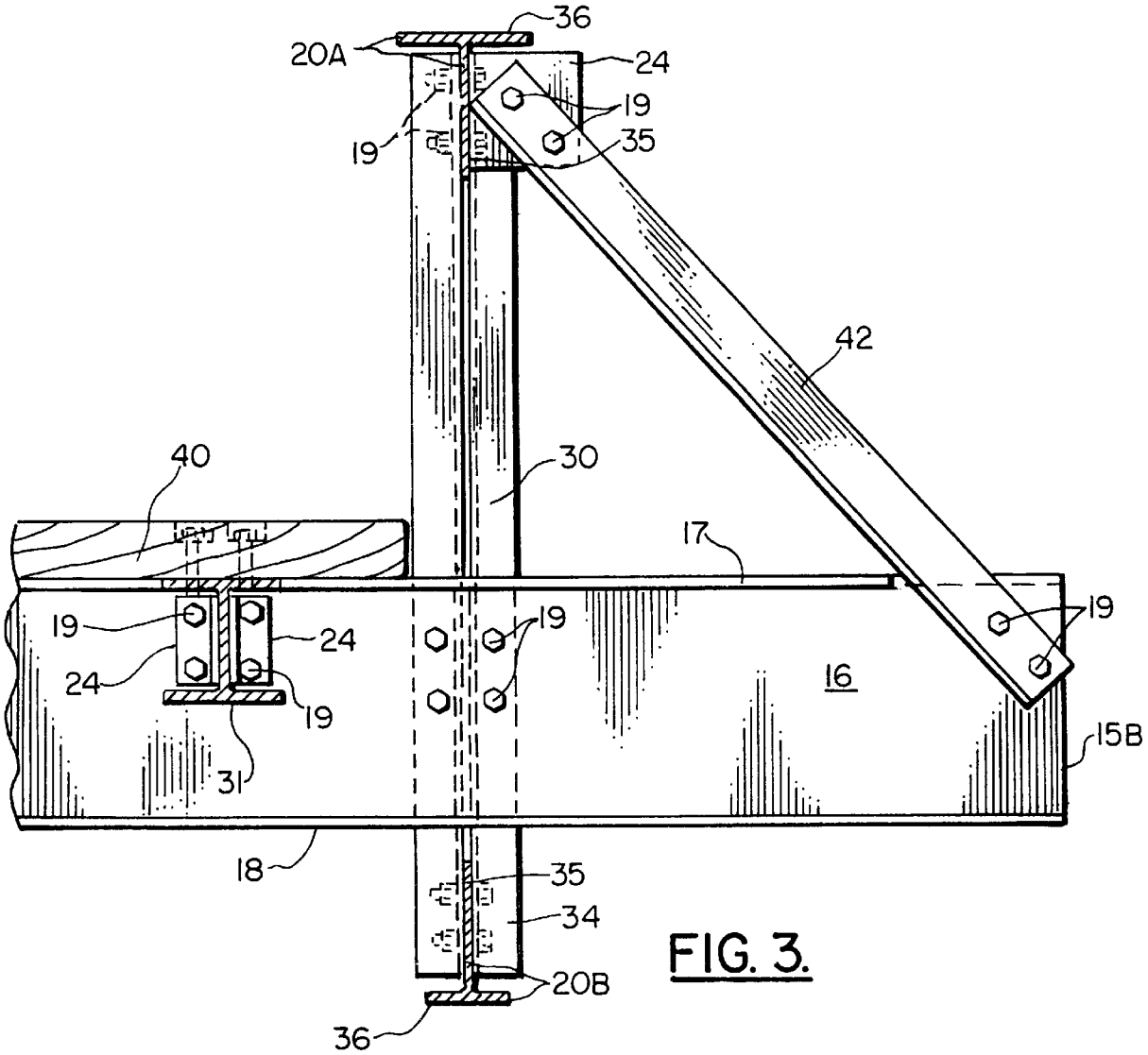
FIG. 3 is a sectional view taken along lines 3—3 of FIG. 1.
Figure 4:
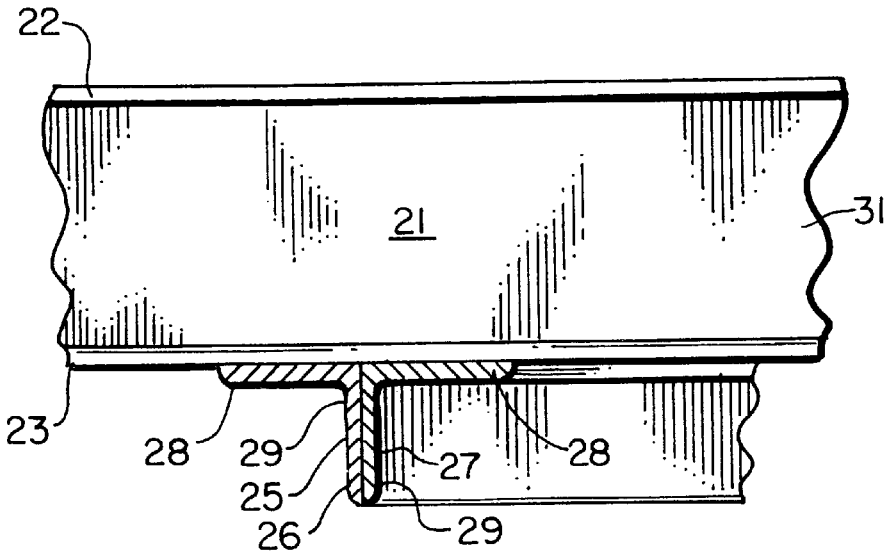
FIG. 4 is a sectional view taken along lines 4—4 of FIG. 1.
Figure 5:
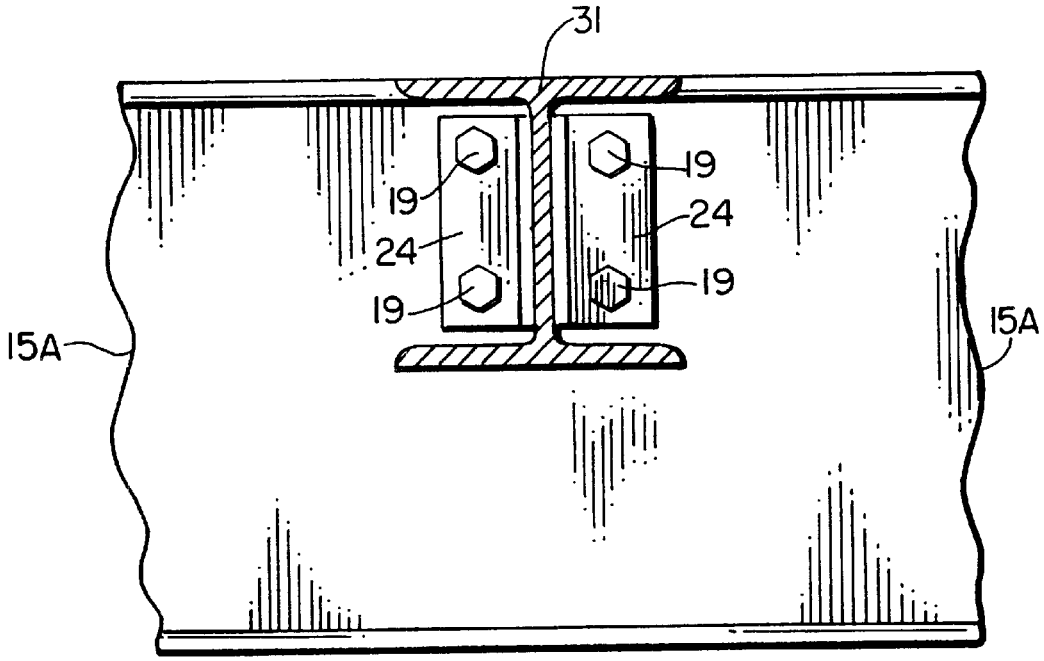
FIG. 5 is a sectional view taken along lines 5—5 of FIG. 1.
Figure 6:
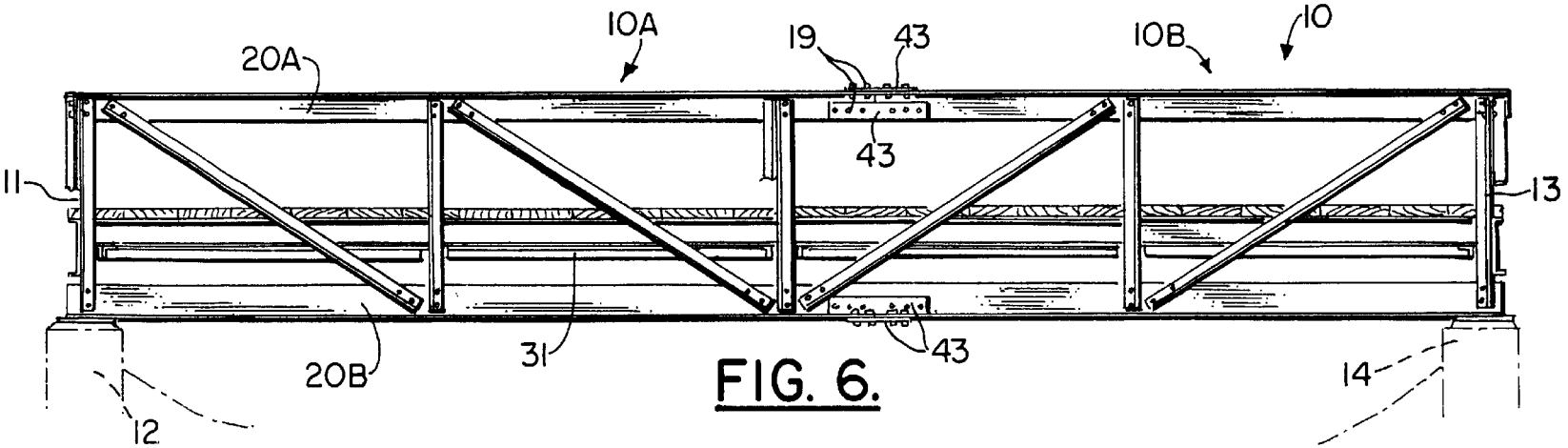
FIG. 6 is an elevation view of the preferred embodiment of the apparatus of the present invention.
Figure 8:
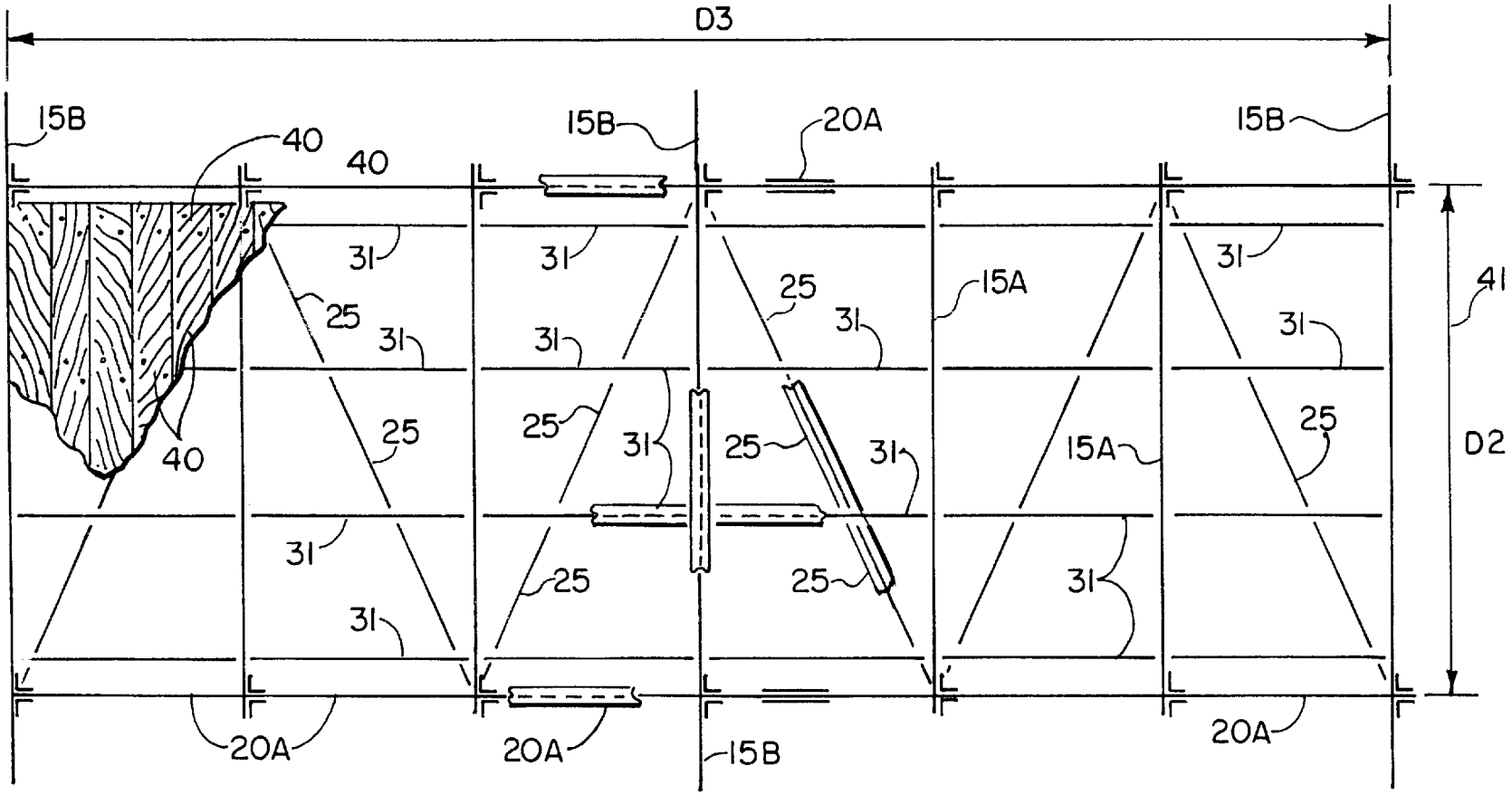
FIG. 8 is a plan view of the preferred embodiment of the apparatus of the present invention showing a longer version of the bridge shown in FIG. 1.

In FIGS. 1–5, diagonal beams 25 are shown extending diagonally from the left truss 37 to the right truss 38 and between adjacent vertical members 30 in the plan views of FIGS. 1 and 8. The diagonal beams 25 extend under and support a plurality of the transverse beams 15A, 15B (FIG. 4) and form connections with a transverse beam 15A, 15B as shown in FIG. 3. Diagonal beams 25 can be comprised of a pair of angle members 26, 27 positioned back to back as shown in FIG. 4. Each angle member 26, 27 can be comprised of a horizontal flange 28 and a vertical flange 29.

Figure 7:
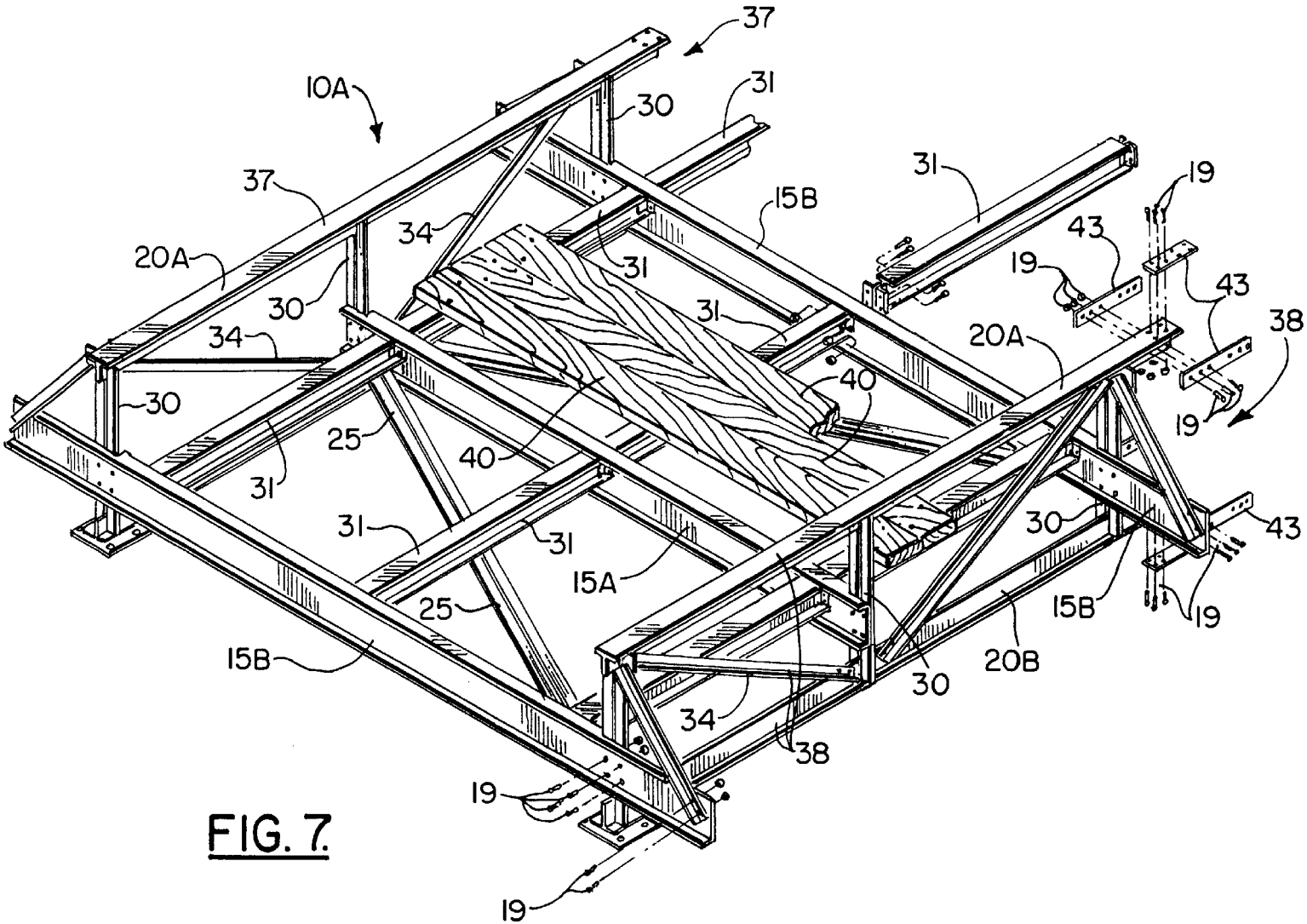
FIG. 7 is a partial, perspective view of the preferred embodiment of the apparatus of the present invention.

Vertical member 30 spans between an upper longitudinal chord member 20A and a lower longitudinal chord member 20B at each transverse deck beam 15A, 15B as shown in FIGS. 2–3 and 7. Each vertical web member 30 can be comprised of a pair of angle members 32, 33. Other inclined members span between upper longitudinal beams 20A and lower longitudinal beams 20B. These include diagonally inclined web members 34.

As shown in FIGS. 2 and 7, the diagonally inclined web members 34 span between upper longitudinal chord members 20A and lower longitudinal chord members 20B. Each diagonally inclined web members 34 connects to lower longitudinal chord member 20B at a position that is next to the connection between lower longitudinal chord member 20B and vertical web member 30 as shown in FIG. 2. At upper longitudinal chord member 20A, diagonally inclined web member 34 connects to upper longitudinal chord member 20A at the connection that is between vertical web member 30 and upper longitudinal chord member 20A.

Diagonal braces or "kickers" 42 extend between the end of a longer transverse beam 15B and the top of vertical web member 30 (see FIG. 3).

Bridge decking 40 is placed upon the combination of deck beams that include bridge deck beams 15A and longitudinal deck beams 31. Decking 40 does not extend the full length of the longer bridge deck beams 15B as the decking 40 only extends the inside width of the bridge designated by the arrow D2 in FIG. 1 which is basically the spacing between vertical members 30 on the left and right sides of the bridge 10. In FIG. 1, the numeral 41 shows the width of the bridge 10. The bridge decking 40 is attached (eg. bolted) to the deck beams 15A, 15B, 31 to provide a road surface for vehicles, pedestrians and the like.

What is claimed is:

1. A modular bridge apparatus, comprising:

a) left and right truss sections, each truss section defining left and right truss side portions of the bridge apparatus;

b) each truss section having a top with an upper longitudinal chord member and a bottom with a lower longitudinal chord member;

c) a plurality of laterally extending beams that extend between the left and right truss sections;

d) a plurality of inclined beams that include at least some generally vertical beams and some diagonally extending beams, including some inclined beams that extend between and directly connect to an upper and a lower chord member on the left truss and some inclined beams that extend between and directly connect to an upper and a lower chord member on the right;

e) a plurality of joints that connect beams and chord members together including at least joints that connect a lower longitudinal chord member to a vertical beam and to at least one diagonal member;

f) a plurality of laterally extending horizontal deck beams extending transversely between the left and right trusses, each one between two generally vertical beams and at an elevation that is higher than the elevation of the lower longitudinal chord members, at least some of the laterally extending beams extending laterally beyond each lower longitudinal chord member;

g) a plurality of diagonally and laterally extending inclined beams that each extend between an end portion of a laterally extending horizontal beam and a truss side at a position near an upper chord member; and h) an expanse of bridge decking that is attached to the deck beams.

2. The modular bridge apparatus of claim 1 wherein all of the bridge beams and bridge decking are light enough so that the bridge can be manually erected using only small lifting aids.

3. The modular bridge apparatus of claim 1 wherein there are a first plurality of laterally extending deck beams of a first shorter length and a second plurality of longer laterally extending deck beams of a second length.

4. The modular bridge apparatus of claim 1 wherein there are a plurality of said diagonally and laterally extending inclined beams.

5. The modular bridge apparatus of claim 1 wherein the joints include bolted connections.

6. The modular bridge apparatus of claim 1 wherein the bridge decking is positioned at an elevation that is spaced above the lower longitudinal chord members.

7. The modular bridge apparatus of claim 1 wherein the decking has a width and at least some of the transverse beams extend transversely beyond the width of the decking.

8. The modular bridge apparatus of claim 1 wherein the decking has left and right sides, and at least some of the transverse deck beams extend transversely to the sides of the decking and other of the transverse beams extend transversely beyond the width of the decking and beyond both sides of the decking.

9. The modular bridge apparatus of claim 1 wherein the diagonally and laterally extending beams are provided on both sides of the decking.

10. The modular bridge of claim 8 wherein the deck beams include longer deck beams that have end portions, both end portions of a longer deck beam having one of said diagonally and laterally extending inclined beams attached thereto.

11. A modular bridge apparatus, comprising:

a) left and right trusses;

b) each truss having a top and bottom, a longitudinal upper chord member at the top and a lower longitudinal chord member at the bottom;

c) a plurality of laterally extending beams that extend between the left and right trusses;

d) a plurality of inclined beams that include at least some diagonally extending beams, including some inclined beams that extend between and directly connect to an upper and a lower chord member on the left truss and some inclined beams that extend between and directly connect to an upper and a lower chord member on the right truss;

e) a plurality of joints that connect beams together, including at least joints that connect a lower longitudinal chord member to a vertical beam and to at least one diagonal beam;

f) a plurality of transverse horizontal beams extending at an elevation that is above the elevation of the lower longitudinal chord members, some of the transverse horizontal beams being longer beams that extend laterally beyond the longitudinal chord members;

g) a plurality of diagonally and laterally extending inclined beams that each extend between an end portion of a laterally extending horizontal beam and a truss at a position near an upper chord member; and h) an expanse of bridge decking that is attached to the truss at the transverse horizontal beams.

12. A modular bridge apparatus, comprising:

a) left and right truss sections, each truss section defining left and right truss side portions of the bridge apparatus;

b) each truss section having a plurality of upper longitudinal chord members and a plurality of lower longitudinal chord members, and a plurality of inclined beams that include at least some generally vertical beams and some diagonally extending beams, including some inclined beams that extend between and directly connect to an upper and a lower chord member on the left truss and some inclined beams that extend between and directly connect to an upper and a lower chord member on the right truss;

c) a plurality of laterally extending beams that extend between the left and right truss sections;

d) a plurality of joints that connect beams and chord members together including a plurality of lower joints that connect a lower longitudinal chord member to a vertical beam and to at least one diagonal member and a plurality of upper joints that connect an upper chord member to an inclined beam;

e) a plurality of laterally extending horizontal deck beams extending transversely between the left and right trusses by spanning between and connecting to a pair of generally vertical beams and at an elevation that is higher than the elevation of the lower joints, at least some of the laterally extending beams extending laterally beyond each lower longitudinal chord member;

f) a plurality of diagonally and laterally extending inclined beams that each extend between an end portion of a laterally extending horizontal beam and a truss side at a position that is next to an upper chord member; and g) an expanse of bridge decking that is attached to the deck beams.

13. The modular bridge apparatus of claim 12 wherein all of the bridge beams and bridge decking are light enough so that the bridge can be manually erected using only small lifting aids.

14. The modular bridge apparatus of claim 12 wherein there are a first plurality of laterally extending deck beams of a first shorter length and a second plurality of longer laterally extending deck beams of a second length.

15. The modular bridge apparatus of claim 12 wherein there are a plurality of, said diagonally and laterally extending inclined beams.

16. The modular bridge apparatus of claim 12 wherein the joints include bolted connections.

17. The modular bridge apparatus of claim 12 wherein the bridge decking is positioned at an elevation that is spaced above the lower longitudinal chord members.

18. The modular bridge apparatus of claim 12 wherein the decking has a width and at least some of the transverse beams extend transversely beyond the width of the decking.

19. The modular bridge apparatus of claim 12 wherein the decking has left and right sides, and at least some of the transverse deck beams extend transversely to the sides of the decking and other of the transverse beams extend transversely beyond the width of the decking and beyond both sides of the decking.

20. The modular bridge apparatus of claim 12 wherein the diagonally and laterally extending beams are provided on both sides of the decking.

21. The modular bridge of claim 19 wherein the deck beams include longer deck beams that have end portions, both end portions of a longer deck beam having one of said diagonally and laterally extending inclined beams attached thereto.

22. A modular bridge apparatus, comprising:

a) left and right trusses;

b) each truss having a top and bottom, a plurality of upper longitudinal chord members defining the top and a plurality of lower longitudinal chord members defining the bottom;

c) a plurality of laterally extending beams that extend between the left and right trusses;

d) a plurality of inclined beams that span between and directly connect to upper and lower chord members, and include at least some diagonally extending beams;

e) a plurality of joints that connect beams together, including upper joints that connect one or more upper longitudinal chord members to an inclined beam and lower joints that connect one or more lower longitudinal beams to an inclined beam and at least one diagonal beam;

f) a plurality of transverse horizontal beams extending between the left and right trusses, connecting thereto at intermediate joints above the elevation of the lower joints, some of the transverse horizontal beams being longer beams that extend laterally beyond the longitudinal chord members;

g) a plurality of diagonally and laterally extending inclined beams that each extend between an end portion of a laterally extending horizontal beam and a truss at a position near an upper chord member; and h) an expanse of bridge decking that is attached to the truss at the transverse horizontal beams.

23. The modular bridge apparatus of claim 22 wherein there are a first plurality of laterally extending deck beams of a first shorter length and a second plurality of longer laterally extending deck beams of a second length.

24. The modular bridge apparatus of claim 22 wherein there are a plurality of said diagonally and laterally extending inclined beams.

25. The modular bridge apparatus of claim 22 wherein the joints include bolted connections.

26. The modular bridge apparatus of claim 22 wherein the bridge decking is positioned at an elevation that is spaced above the lower longitudinal chord members.

27. The modular bridge apparatus of claim 22 wherein the decking has a width and at least some of the transverse beams extend transversely beyond the width of the decking.

28. The modular bridge apparatus of claim 22 wherein the decking has left and right sides, and at least some of the transverse deck beams extend transversely to the sides of the decking and other of the transverse beams extend transversely beyond the width of the decking and beyond both sides of the decking.

29. The modular bridge apparatus of claim 22 wherein the diagonally and laterally extending beams are provided on both sides of the decking.

30. The modular bridge of claim 28 wherein the deck beams include longer deck beams that have end portions, both end portions of a longer deck beam having one of said diagonally and laterally extending inclined beams attached thereto.

* * * * *